US009090849B2

(12) United States Patent
Adamczewska et al.

(10) Patent No.: US 9,090,849 B2
(45) Date of Patent: Jul. 28, 2015

(54) ENGINE OIL FORMULATIONS FOR BIODIESEL FUELS

(75) Inventors: Jola Adamczewska, Derby (GB); Mark C. Davies, Belper (GB); Craig J. Jones, Wessington (GB)

(73) Assignee: The Lubrizol Corporation, Wickliffe, OH (US)

( * ) Notice: Subject to any disclaimer, the term of this patent is extended or adjusted under 35 U.S.C. 154(b) by 515 days.

(21) Appl. No.: 12/810,068

(22) PCT Filed: Dec. 18, 2008

(86) PCT No.: PCT/US2008/087411

§ 371 (c)(1), (2), (4) Date: Jul. 28, 2010

(87) PCT Pub. No.: WO2009/085943

PCT Pub. Date: Jul. 9, 2009

(65) Prior Publication Data

US 2010/0286002 A1 Nov. 11, 2010

Related U.S. Application Data

(60) Provisional application No. 61/016,856, filed on Dec. 27, 2007.

(51) Int. Cl.

*C10M 159/24* (2006.01)
*C10M 129/70* (2006.01)
*C10M 159/20* (2006.01)

(52) U.S. Cl.

CPC ..... *C10M 159/24* (2013.01); *C10M 159/20* (2013.01); *C10M 2207/028* (2013.01); *C10M 2207/262* (2013.01); *C10M 2215/28* (2013.01); *C10M 2219/046* (2013.01); *C10M 2223/045* (2013.01); *C10N 2230/02* (2013.01); *C10N 2230/04* (2013.01); *C10N 2230/10* (2013.01); *C10N 2230/45* (2013.01); *C10N 2230/78* (2013.01); *C10N 2240/102* (2013.01); *C10N 2240/103* (2013.01)

(58) Field of Classification Search

USPC ..... 508/154, 391, 459; 44/307, 385

See application file for complete search history.

(56) References Cited

U.S. PATENT DOCUMENTS

| | | | | |
|---|---|---|---|---|
| 5,202,036 | A * | 4/1993 | Ripple et al. | 508/192 |
| 5,688,751 | A | 11/1997 | Cleveland et al. | |
| 5,880,075 | A | 3/1999 | Hartley et al. | |
| 6,008,165 | A | 12/1999 | Shanklin et al. | |
| 6,010,986 | A | 1/2000 | Stachew et al. | |
| 6,054,420 | A | 4/2000 | Hartley et al. | |
| 6,727,208 | B2 | 4/2004 | Wilk | |
| 6,828,287 | B1 | 12/2004 | Lakes et al. | |
| 2003/0163948 | A1 | 9/2003 | Van Leest et al. | |
| 2004/0211112 | A1 | 10/2004 | Clague et al. | |
| 2004/0248744 | A1 | 12/2004 | King et al. | |
| 2004/0266630 | A1 | 12/2004 | George et al. | |
| 2004/0266631 | A1 | 12/2004 | Burrington et al. | |
| 2006/0288637 | A1 * | 12/2006 | Choo et al. | 44/385 |
| 2007/0049505 | A1 | 3/2007 | Baker et al. | |
| 2007/0289203 | A1 | 12/2007 | Deblase et al. | |
| 2008/0182768 | A1 | 7/2008 | Devlin et al. | |

FOREIGN PATENT DOCUMENTS

| | | |
|---|---|---|
| WO | 2005003266 | 1/2005 |
| WO | 2007111698 | 10/2007 |
| WO | 2007120352 | 10/2007 |

OTHER PUBLICATIONS

Frohlich A. et al., "Evaluation of Camelina sativa oil as feedstock for biodiesel production", Industrial Crops and Products, Elsevier, NL., vol. 21, No. 1, Jan. 1, 2005, pp. 25-31, XP025332429.

Corresponding PCT Publication WO 2009/085943 A1 which includes the PCT Search Report, Jul. 9, 2009.

Written Opinion from Corresponding PCT Application No. PCT/US2008/087411 completed Apr. 28, 2009.

* cited by examiner

*Primary Examiner* — James Goloboy

(74) *Attorney, Agent, or Firm* — David M. Shold

(57) ABSTRACT

The lubricant for an internal combustion engine fueled by a biodiesel fuel (that is, a liquid fuel containing a C1-C4 alkyl ester of a carboxylic acid of about 12 to about 24 carbon atoms) exhibits improved resistance to oxidative degradation when the lubricant contains an alkali metal detergent.

16 Claims, No Drawings

ENGINE OIL FORMULATIONS FOR BIODIESEL FUELS

BACKGROUND OF THE INVENTION

The disclosed technology relates to lubricants for internal combustion engine, particularly those fueled with biodiesel fuels.

Biodiesel is a general term for fuel-grade materials derived from natural sources such as vegetable oils. They are often fatty acid methyl esters ("FAME") such as rapeseed methyl ester ("RME") of soya methyl ester ("SMA"). Biodiesel fuels are becoming more prevalent for fueling of diesel engines. The increased use of diesel passenger vehicles in Europe and elsewhere is in part a cause of this increase. Current European diesel standard allow for 5% bio-diesel component to be incorporated into fuels, with indications that 10% bio-diesel content will be soon permitted.

Simultaneously, there is continued pressure for reducing particulate matter emissions from diesel engines. Euro 5 requirements, scheduled for implementation in 2009, require reduction in particulate matter to 0.05 g/km. Such levels can only be attained, practically, by use of a diesel particulate filter. These filters require regeneration once they are full of soot, and this is typically achieved by increasing the filter temperature to burn off the soot. The temperature increase is often achieved by post-injection of fuel into the engine cylinder.

However, post-injection of fuel can have the undesirable effect of fuel-dilution of the engine lubricant, as more cylinder wall wetting by the fuel allows more fuel to migrate to and accumulate in the lubricant sump. Bio-diesel components are typically less volatile than conventional mineral diesel fuel, and thus concentration of such components in the sump is exacerbated. In fact, use of bio-diesel fuel (B05, i.e., containing 5% ester) along with post-Injection may result in 40% fuel dilution of the lubricant, and the bio-diesel component may account for 50% of the diluent. These high levels of bio-diesel in the oil may lead to increased oxidation and deposit formation associated with the lubricant.

Detergents based on a variety of metal compounds are known. U.S. Pat. No. 5,688,751, Cleveland et al., Nov. 18, 1997, discloses salicylate salts as lubricants for two cycle engines. Suitable additives include the potassium or sodium salts of $C_{16}$ alkylphenol and of a $C_{9-18}$ or $C_{13-18}$ alkyl salicylate.

U.S. Pat. No. 6,008,165, Shanklin et al., Dec. 28, 1999, discloses a composition for reducing the copper-lead bearing corrosion of a formulation, in particular for engine oils, containing a metal overbased composition comprising at least one carboxylate, phenate, or sulfonate wherein the metal is lithium, sodium, potassium, magnesium or calcium. An example is a sodium overbased sulfonic acid. The composition contains a borated dispersant.

U.S. Pat. No. 6,010,986, Stachew et al., Jul. 31, 1998, discloses a composition for reducing the copper-lead bearing corrosion of a formulation, in particular for engine oils, containing a metal overbased composition comprising at least one carboxylate, phenate, or sulfonate wherein the metal is lithium, sodium, potassium, magnesium or calcium. The composition includes a dispersant that is substantially boron-free.

The disclosed technology provides a lubricant composition suitable for sump lubricated engines fueled by a liquid fuel which includes a bio-diesel component, which exhibits improved oxidation resistance and/or reduced deposit formation in lubricants which contain a portion of the bio-diesel component. This is accomplished by the presence of the alkali metal detergent described hereinafter.

SUMMARY OF THE INVENTION

The disclosed technology provides a method for lubricating a sump-lubricated internal combustion engine fueled by a liquid fuel which comprises a C1-C3 or C1-C4 alkyl ester of a carboxylic acid of about 12 to about 24 carbon atoms, comprising supplying to the sump a lubricant comprising an oil of lubricating viscosity and a minor amount of an oil-soluble alkali metal salt, such as a detergent.

Also provided is a lubricant composition comprising (a) an oil of lubricating viscosity; (h) at least about 1 or about 2 percent by weight of a C1-C3 or C1-C4 alkyl ester of a carboxylic acid of about 12 to about 24 carbon atoms; and (c) a minor amount of an alkali metal detergent. The ester may be intentionally present in the lubricant composition or it may be present as a result of fueling an engine with a fuel containing the ester. In one embodiment the presence of the ester arises from dilution of the lubricant by a liquid fuel.

Also provided is a method of reducing oxidative degradation of a lubricant composition which contains an oil of lubricating viscosity and at least about 1 or about 2 percent by weight of a C1-C3 or C1-C4 alkyl ester of a carboxylic acid of about 12 to about 24 carbon atoms, the presence of which may arise from dilution of the lubricant by a liquid fuel, comprising including within said lubricant composition a minor amount of an alkali metal detergent.

DETAILED DESCRIPTION OF THE INVENTION

Various preferred features and embodiments will be described below by way of non-limiting illustration.

The lubricant as described herein is particularly useful for lubricating diesel engines that are fueled with a liquid fuel that comprises a bio-diesel fuel, that is, that contains a certain amount, e.g., at least 2 percent by weight, of a C1-C3 or C1-C4 alkyl ester of a carboxylic acid of 12 to 24 carbon atoms. Such alkyl groups may include methyl, ethyl, 1-propyl, 2-propyl, n-butyl, sec-butyl, isobutyl, or tert-butyl. The amount of such ester in the liquid fuel may be 2 to 100% by weight, or 4 to 100% or 5 to 100% or 10 to 100%, for instance, 4 to 12% or 5 to 10% or generally 2, 4, 5, 10 or 12% up to 100 or 90 or 80 or 50 or 30%. These percentages are normally calculated on the basis of the liquid fuel excluding any performance additives that may be present. The balance of the fuel may be a petroleum-derived fuel or fraction, such as a middle distillate fuel or other petroleum fuel conventionally used to fuel a diesel engine. The amount of sulfur in the fuel may be less than 300 parts per million by weight for low sulfur fuels, or less than 50 ppm or less than 10 ppm, e.g., 1 to 10 ppm S for ultra-low sulfur fuels. Fuels may also contain higher levels of sulfur, such as up to 1000 ppm or 300 to 500 ppm. Any sulfur which is present may come from 2.0 the bio-diesel component or from a petroleum fraction.

Bio-diesel fuels can be derived from animal fats and/or vegetable oils to include biomass sources such as plant seeds as described in U.S. Pat. No. 6,166,231, The esters may thus be methyl, ethyl, propyl, or isopropyl esters. The carboxylic acids may be derived from natural or synthetic sources and may contain a relatively pure or single component of acid in terms of chain length, branching, and the like, or they may be mixtures of acids characteristic of acids obtained from animal or, especially, vegetable sources.

Bio-diesel fuels thus include esters of naturally occurring fatty acids such as the methyl ester of rapeseed oil which can generally be prepared by transesterifying a triglyceride of a natural fat or oil with an aliphatic alcohol having 1 to 3 carbon atoms. Other suitable materials include the methyl esters of soybean oil, sunflower oil, coconut oil, corn oil, olive oil, palm oil, jatropha oil, peanut oil, canola oil, babassu oil, castor oil, and sesame seed oil. Such materials comprise a mixture of acids most typically of 8 to 24 or 12 to 22 or 16 to 18 carbon atoms, with varying degrees of branching or unsaturation. In one embodiment, the acid is unsaturated. Rapeseed oil, for instance, is believed to comprise largely oleic acid (C18), linoleic acid (C18), linolenic acid (C18), and in some cases erucic acid (C22). Certain amounts of vegetable oils (triglycerides) may also be included in some embodiments.

The lubricant composition described herein comprises an oil of lubricating viscosity. The oil, sometime referred to as base oil, may be selected from any of the base oils in Groups I-V as specified in the American Petroleum Institute (API) Base Oil Interchangeability Guidelines. The five base oil groups are as follows:

| Base Oil Category | Sulfur (%) | | Saturates(%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils; are often used.

Natural oils include animal oils and vegetable oils (e.g. castor oil, lard oil and other vegetable oils) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Alkylene oxide polymers and interpolymers and derivatives thereof, and those where terminal hydroxyl groups have been modified by, for example, esterification or etherification, constitute other classes of known synthetic lubricating oils that can be used. Another suitable class of synthetic lubricating oils that can be used comprises the esters of dicarboxylic acids and those made from C5 to C12 monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used as well as oils prepared by a Fischer-Tropsch gas-to-liquid synthetic procedure.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

When a lubricant is used in connection with a bio-diesel fuel, a portion of the ester component of the fuel will typically migrate into the lubricant, as described above. Thus, in some embodiments in which the present invention is employed, the lubricant will contain at least 1 percent by weight or at least 2 or 4 or 5 percent by weight of the ester component. The amount of ester component in the lubricant may be as high as 15 or 20 or 30 or 40 percent or possibly even higher.

The lubricant will contain various additives, including an oil-soluble alkali metal salt. Such salts will generally be soluble if they contain at least one relatively long hydrocarbyl chain. They are typically in the form of a detergent. Thus, the lubricant will typically contain one or more detergents, as defined in greater detail below, Detergents are generally basic alkali or alkaline earth metal salt of an acidic organic compound. These salts are generally, and are often referred to as, overbased materials. Overbased materials are single phase, homogeneous Newtonian systems characterized by a metal content in excess of that which would be present according to the stoichiometry of the metal and the particular acidic organic compound reacted with the metal.

The amount of excess metal is commonly expressed in terms of metal ratio. The term "metal ratio" is the ratio of the total equivalents of the metal to the equivalents of the acidic organic compound. A neutral metal salt has a metal ratio of 1. A salt having 4.5 times as much metal as present in a normal salt will have metal excess of 3.5 equivalents, or a ratio of 4.5. The basic salts may, for instance, have a metal ratio of 1.5 or 3 or 7, up to 40 or to 25 or to 20. The basicity of the overbased materials may be expressed as total base number (TBN), e.g., ASTM D 4739.

Overbased detergents are typically prepared by reacting an acidic material such as carbon dioxide with a mixture of an acidic organic compound, an inert reaction medium comprising at least one inert organic solvent such as mineral oil a stoichiometric excess of a metal base compound, and a promoter.

The acidic organic compounds useful in making overbased compositions, sometimes referred to as the "substrate," include carboxylic acids (such as hydrocarbyl-substituted salicylic acids), sulfonic acids (such as hydrocarbyl-substituted benzenesulfonic acids), phosphorus-containing acids, phenols, and mixtures thereof.

Illustrative examples of sulfonic acids include mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having 8 or 12 to 30 carbon atoms, such as about 24 carbon atoms. Such acids include di-isododecyl-benzenesulfonic acid. Also included are polyisobutene-substituted benzenesulfonic acids derived from polyisobutene having an $\overline{M}_n$ of 300-3000, or 500 to 1500 or 1500 to 2500. Others include benzenesulfonic acids substituted by polypropylene or by mixed isomers of linear olefins, of similar molecular weights. A mixture of monoalkylated aromatics (benzene) may be utilized to obtain the salt (e.g., monoalkylated benzene sulfonate). Mixtures wherein a substantial portion of the salt contains polymers of propylene as the source of the alkyl groups may assist in solubility.

The production of sulfonates from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp, 291 et seq. published by John Wiley &. Sons, N.Y. (1969).

The metal compounds useful in making detergents are generally any Group 1 or Group 2 metal compounds (CAS version of the Periodic Table of the Elements). The Group 1 metals of the metal compound include Group 1a alkali metals (sodium, potassium, lithium) as well as Group 1b metals such as copper. The Group 2 metals of the metal base include the Group 2a alkaline earth metals (magnesium, calcium, barium) as well as the Group 2b metals such as zinc or cadmium. Generally the metal compounds are delivered as metal salts. The anionic portion of the salt can be hydroxide, oxide, carbonate, borate, or nitrate.

Patents disclosing techniques for making basic salts of the above-described sulfonic acids, carboxylic acids, and mixtures thereof include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Also included are salixarate detergents. These include overbased materials prepared from salicylic acid (which may be unsubstituted) with a hydrocarbyl-substituted phenol, such entities being linked through —$CH_2$— or other alkylene bridges. It is believed that the salixarate derivatives have a predominantly linear, rather than macrocyclic, structure, although both structures are intended to be encompassed by the term "salixarate." Salixarate derivatives and methods of their preparation are described in greater detail in U.S. Pat. No. 6,200,936 and PCT Publication WO 01/56968.

The overbased salt may also be a borated complex. Borated complexes of this type can be prepared by heating the basic metal salt with boric acid at about 50-100° C., the number of equivalents of boric, acid being up to roughly equal to the number of equivalents of metal in the salt. U.S. Pat. No. 3,929,650 discloses borated complexes and their preparation, in another embodiment, the overbased salt, that is, the detergent, and in particular, the alkali metal detergent, as described below, is not borated, or contains less than 1 percent or less than 0.1 percent, e.g., 0.002 to 0.05 percent or 0.005 to 0.02 percent, boron.

For purposes of the present invention, the detergent should be or include an alkali metal detergent, which may be (but need not necessarily be) an overbased alkali metal detergent. The alkali metal may be sodium. The detergent may be a sulfonate detergent, and may, in particular, be an overbased sodium sulfonate detergent. The TBN of such a detergent may be, for instance, 50 to 900 or 100 to 800 or 200 to 750 or 300 to 700 (being calculated on an oil-free basis. The measured TBN will be proportionally lower if the conventional amount of diluent oil is included.).

The amount of the alkali metal detergent (or, more generally, the oil-soluble alkali metal salt) is typically 0.01 to 5 percent by weight of the lubricant composition, or, in other embodiments, 0.1 to 3 or 0.2 to 2 or 0.3 to 1 percent by weight. These amounts will refer to the total amount of alkali metal detergents, if more than one such detergent is present. The alkali metal detergent may also be presented in the form of a concentrate for subsequent addition to base oil to form a final lubricant product. In such a concentrate, the amount of alkali metal detergent will be correspondingly increased, such as 1 to 50 percent or 10 to 30 percent by weight. Percentages are expressed as the amount of active chemical of the detergent, excluding the amount of any diluent oil that is customarily commercially supplied along with the detergent. The amount of the alkali metal salt (or detergent) will generally be an amount to provide 250 to 5000 parts per million by weight of the alkali metal (e.g., sodium) to the lubricant, or, alternatively, 500 to 3000 parts per million or 800 to 2000 or 1000 to 1500 or 700 to 1200 parts per million. The amount of such salt or detergent may also be the amount sufficient to provide 0.2 to 20 TBN units to the lubricant, or alternatively 0.5-15 or 0.8-10 or 1-5 or 2-4 TBN units.

The alkali metal salt or detergent may be supplied to the lubricant of an engine in a variety of ways. In one embodiment, the alkali metal detergent is added to a concentrate of other lubricant additives that is then blended into a finished lubricant. In another embodiment, the alkali metal detergent is added, as a top-treat, to a finished lubricant containing other lubricant additives. In both of the foregoing methods, the salt or detergent is added directly to the lubricant and is typically present in the lubricant from the beginning of its actual use as a lubricant. That is, in such methods it is not added to the lubricant during the course of the use of the lubricant. However, in yet another embodiment, the alkali metal detergent is added to the lubricant in a controlled or slow release method which may be during the course of the use of the lubricant.

The alkali metal detergent can thus be part of a slow release lubricant additive package in the form of a lubricant additive gel which is formulated to meet the performance requirements of the system, whereby the slow release of the component of the gelled lubricant additive conditions the fluid. Gels are materials that comprise mixtures of two or more substances and which exist in a semi-solid state more like a solid than a liquid. See, for instance, Parker, "Dictionary of Scientific and Technical Terms," Fifth Edition, McGraw Hill, 1994, and, Larson, "The Structure and Rheology of Complex Fluids," Chapter 5, Oxford University Press, New York, N.Y., 1999.

A category of gels suitable for use in accordance with the present invention are those in which gellation occurs through the combination of an overbased detergent and an ashless succinimide dispersant. In this embodiment, the ratio of the detergent to the dispersant may be 10:1 to 1:10 or 5:1 to 1:5 or 4:1 to 1:1 or to 2:1. Examples of this method of supplying an additive to lubricating oil in such a manner can be found in U.S. Pat. Nos. 6,843,916 and 7,000,655 as well as U.S. Patent Application 20050085399.

Another means of supplying the alkali metal detergent to the lubricant is by addition of the alkali metal detergent to the fuel used to operate an engine, whence it may migrate or leak or be carried into the lubricant system. The alkali metal detergent may be added to the bulk fuel as part of a concentrate used to provide a finished formulated fuel or as a top treat Examples of providing a benefit to lubricating oil via a fuel additive can be found in U.S. Patent Applications 20050115146 and 20050215441. The fuel additive may be a solid additive composition as described in U.S. Patent Application 20060229215.

In one embodiment, the alkali metal detergent can be added to the fuel via contacting the fuel with a gel comprising the alkali metal detergent, where the gel is appropriately positioned within the fuel system to permit contact with the fuel. The gel can be added also to the fuel by the fuel supplier at a refinery, terminal, or a refueling station by premixing the gel with the fuel. Alternatively, the vehicle operator can add the gel to the fuel tank by dosing the tank during refueling. The gel additive may be dosed to the fuel using a fuel dosing system that provides a controlled level of the additive to the fuel (storage) tank. Examples of additizing fuel by means of contacting the fuel with a gel comprising a fuel or lubricant additive can be found in U.S. Patent Application 20060272597.

In addition, the lubricant may contain an alkaline earth metal detergent, that is, in addition to the alkali metal detergent. The common alkaline earths include magnesium, calcium, and barium, calcium being the most commonly used. In certain embodiments, the lubricant is free or substantially free from magnesium such as that derived from a magnesium detergent (e.g., Mg sulfonate). The amount of magnesium in the lubricant may be less than 500 parts per million by weight or less than 420 ppm or less than 200 ppm. In some embodiments there is a minimal amount of Mg present, such as at least 10, 50, 80, or 100 ppm. Each of these limits may be combined to provide ranges such as 10-500 ppm. The alkaline earth metal detergent is, in other respects, substantially similar to the detergents described above in terms of substrate, manufacture, and extent of overbasing. For instance, it may be an overbased calcium sulfonate detergent. The calcium detergent, e.g., an overbased Ca sulfonate detergent, may, in some embodiments, have a metal ratio of 1-20 or 1-12 or 1-5. Alternative lower limits on such metal ratios may be 1.1 or 1.2 or 1.5 or 2.0. The alkaline earth metal detergent may be based on the same or a different substrate than that of the alkali metal detergent. The TBN of this optional detergent may be, for instance, 50 to 900 or 100 to 800 or 200 to 750 or 300 to 700 (oil free).

The amount of the alkaline earth metal detergent, if it is present in the lubricant composition, may be 0.05 to 5 percent by weight, or alternatively 0.1 to 3 percent or 0.3 to 2 percent or 0.5 to 1 percent. These amounts will refer to the total amount of alkaline earth metal detergents, if more than one such detergent is present. If presented within a concentrate, the amount of alkaline earth metal detergent will be correspondingly increased, such as 0.5 to 50 percent or 1 to 30 percent.

The present lubricant compositions may also contain a dispersant such as a nitrogen-containing dispersant. Dispersants are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

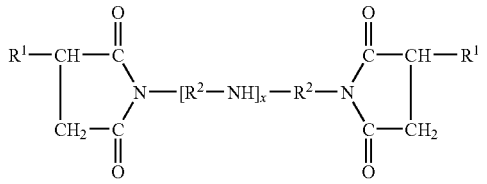

where each $R^1$ is independently an alkyl group, frequently a polyisobutylene group derived from polyisobutylene with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5, Succinimide dispersants are more fully described in U.S. Pat. Nos. 4,234,435 and 3,172,892.

Succinimide dispersants employed in the present lubricant composition may be those prepared by the thermal route or by the so-called chlorine route, or mixtures of detergents from both routes. The two types of materials are described in greater detail in US Patent Application 2005-0202981, Briefly, dispersants from the chlorine route are typically prepared by reacting a polymer such as polyisobutylene, less than 20 percent of the chains thereof containing a terminal vinylidene end group, with maleic anhydride in the presence of chlorine and reacting the product with an amine. Typically in such product at least one succinic moiety is attached to the polyisobutene substituent through a cyclic linkage, for instance 85-93 or up to 95 percent or up to 98 percent of such attachments may be cyclic. Dispersants from the thermal "ene" route are typically prepared by reacting a polyisobutylene, at least 70 percent of the chains thereof containing a terminal vinylidene end group, with maleic anhydride in the substantial absence of chlorine and reacting the product with an amine. Typically in such product at least one succinic anhydride moiety is attached to the polyisobutene substituent through a non-cyclic linkage, and, for instance, at least 90 percent or 95 percent or 98 percent of such attachments may be non-cyclic. It is also believed that the product from the chlorine reaction may contain a certain percentage of internal succinic functionality, that is, along the backbone of the polymer chain, while such internal succinic functionality is believed to be substantially absent from the thermal "ene" material.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich dispersants. These are materials which are formed by the condensation of a higher molecular weight, alkyl substituted phenol, an alkylene polyamine, and an aldehyde such as formaldehyde. Such materials may have the general structure

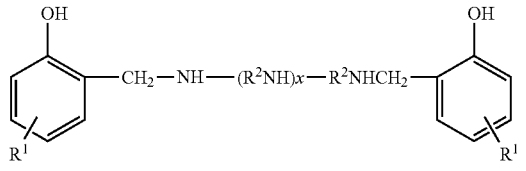

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds, References detailing such treatment are listed in U.S. Pat. No. 4,654,403.

The amount of dispersant, if present in the lubricant, may be 1 to 10 weight percent or 2 to 5 or 4 to 7 weight percent, or correspondingly larger amounts if presented as a concentrate. In certain embodiments the amount of thermal "ene" dispersant in the lubricant is at least 2 or at least 3 percent by weight.

The lubricant may also contain other additives that are known for use in engine lubricants. The lubricant may thus contain a metal salt of a phosphorus acid. Metal salts of the formula $$[(R^8O)(R^9O)P(=S)—S]_n\text{-}M$$

where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of alcohols, for instance, a mixture of isopropanol and 4-methyl-2-pentanol, and in some embodiments a mixture of a secondary alcohol and a primary alcohol, such as isopropanol and 2-ethylhexanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates. Such materials are well known and readily available to those skilled in the art of lubricant formulation.

The lubricant may also contain a viscosity modifier. Most modern engine lubricants are multigrade lubricants which contain viscosity index improvers to provide suitable viscosity at both low and high temperatures. While the viscosity modifier is sometimes considered a part of the base oil, it is more properly considered as a separate component, the selection of which is within the abilities of the person skilled in the art.

Viscosity modifiers generally are polymeric materials characterized as being hydrocarbon-based polymers generally having number average molecular weights between 25,000 and 500,000, e.g., between 50,000 and 200,000.

Hydrocarbon polymers can be used as viscosity index improvers. Examples include homopolymers and copolymers of two or more monomers of C2 to C30, e.g., C2 to C8 olefins, including both alphaolefins and internal olefins, which may be straight or branched, aliphatic, aromatic, alkylaromatic, or cycloaliphatic. Examples include ethylene-propylene copolymers, generally referred to as OCP's, prepared by copolymerizing ethylene and propylene by known processes.

Hydrogenated styrene-conjugated diene copolymers are another class of viscosity modifiers. These polymers include polymers which are hydrogenated or partially hydrogenated homopolymers, and also include random, tapered, star, and block interpolymers. The term "styrene" includes various substituted styrenes. The conjugated diene may contain four to six carbon atoms and may include, e.g., piperylene, 2,3-dimethyl-1,3-butadiene, chloroprene, isoprene, and 1,3-butadiene, Mixtures of such conjugated dienes are useful. The styrene content of these copolymers may be 20% to 70% by weight or 40% to 60%, and the aliphatic conjugated diene content may be 30% to 80% or 40% to 60%. These copolymers can be prepared by methods well known in the art and are typically hydrogenated to remove a substantial portion of their olefinic double bonds.

Esters obtained by copolymerizing styrene and maleic anhydride in the presence of a free radical initiator and thereafter esterifying the copolymer with a mixture of C4-18 alcohols also are useful as viscosity modifying additives in motor oils. Likewise, polymethacrylates (PMA) are used as viscosity modifiers. These materials are typically prepared from mixtures of methacrylate monomers having different alkyl groups, which may be either straight chain or branched chain groups containing 1 to 18 carbon atoms.

When a small amount of a nitrogen-containing monomer is copolymerized with alkyl methacrylates, dispersancy properties are incorporated into the product. Thus, such a product has the multiple function of viscosity modification, pour point depressancy and dispersancy and are sometimes referred to as dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. Dispersant viscosity modifiers may also be interpolymers of ethylene and propylene which are grafted with an active monomer such as maleic anhydride and then derivatized with an alcohol or an amine or grafted with nitrogen compounds.

The lubricant may also comprise an antioxidant. Antioxidants encompass phenolic antioxidants, which may be of the general the formula

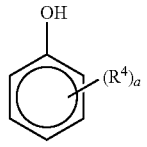

wherein $R^4$ is an alkyl group containing 1 to 24, or 4 to 18, carbon atoms and a is an integer of 1 to 5 or 1 to 3, or 2. The phenol may be a butyl substituted phenol containing 2 or 3 t-butyl groups, such as

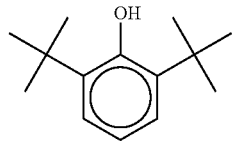

The para position may also be occupied by a hydrocarbyl group or a group bridging two aromatic rings. In certain embodiments the para position is occupied by an ester-containing group, such as, for example, an antioxidant of the formula

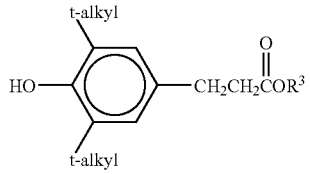

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines, such as those of the formula

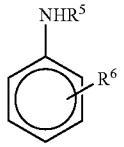

wherein $R^5$ can be an aromatic group such as a phenyl group, a naphthyl group, or a phenyl group substituted by $R^7$, and $R^6$ and $R^7$ can be independently a hydrogen or an alkyl group containing 1 to 24 or 4 to 20 or 6 to 12 carbon atoms, in one embodiment, an aromatic amine antioxidant can comprise an alkylated diphenylamine such as nonylated diphenylamine of the formula

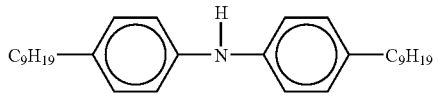

or a mixture of a di-nonyl amine and a mono-nonyl amine.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the present invention include oils, fatty acids and esters, olefins and polyolefins made thereof, terpenes, or Diels-Alder adducts, Details of methods of preparing some such sulfurized materials can be found in U.S. Pat. Nos. 3,471,404 and 4,191,659.

Molybdenum compounds can also serve as antioxidants, and these materials can also serve in various other functions, such as friction modifiers and antiwear agents. The use of molybdenum and sulfur containing compositions in lubricating oil compositions as antiwear agents and antioxidants is known. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent.

Titanium compounds of various types may also be present, and they may serve as deposit control agents and filterability improvers as well as antioxidants. Examples of titanium compounds in lubricants, and their preparation, are described in greater detail in U.S. patent publication 2006-01217271, Sep. 28, 2006. Examples of titanium compounds include titanium (IV) alkoxides such as titanium methoxide, titanium ethoxide, titanium propoxide, titanium isopropoxide, titanium butoxide; and other titanium compounds or complexes including titanium phenates; titanium carboxylates such as titanium (IV) 2-ethyl-1-3-hexanedioate or titanium citrate or titanium oleate; titanium (IV) 2-ethylhexoxide; and titanium (IV) (triethanolaminato)-isopropoxide. Other forms of titanium include the reaction product of titanium compounds with various acid materials to form salts, especially oil-soluble salts. In another embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. In another embodiment, the titanium can be supplied as a tolyltriazole oligomer salted with and/or chelated to titanium, Other forms of titanium can also be provided, such as surface-modified titanium dioxide nanoparticles. The amount of titanium present in the lubricant may typically be 1 to 1000 parts per million by weight (ppm), alternatively 10 to 500 ppm or 10 to 150 ppm or 20 to 500 ppm or 20 to 300 ppm or 30 to 100 ppm or, again, alternatively, 50 to 500 ppm.

The lubricants may also include antiwear agents other than or in addition to those materials mentioned above that may have antiwear properties. Examples of anti-wear agents include phosphorus-containing antiwear/extreme pressure agents such as phosphorus acids, metal thiophosphates, phosphoric acid esters and salts thereof, phosphorus-containing carboxylic acids, esters, ethers, and amides; and phosphites. The phosphorus acids include phosphoric, phosphonic, phosphinic, and thiophosphoric acids including dithiophosphoric acid as well as monothiophosphoric, acids, thiophosphinic acids, and thiophosphonic acids. Non-phosphorus-containing anti-wear agents include borated esters, molybdenum-containing compounds (already described), and sulfurized olefins.

Other additives that may optionally be used in the lubricating oils of this invention include pour point depressing agents, extreme pressure agents, anti-wear agents, color stabilizers and anti-foam agents.

The lubricant may also contain a certain amount of the fatty esters described above as biodiesel fuels. These may or may not be intentionally included in the lubricant composition, but, as discussed above, lubricants in diesel engines burning biodiesel-containing fuels will typically accumulate a certain amount of the esters in the sump along with the rest of the lubricant. The lubricants of the present invention, containing the alkali metal detergent, show superior performance when the lubricant contains the long chain ester, compared to the same lubricants without the alkali metal detergent.

Examples

Lubricant formulations are prepared in a mineral base oil with formulations as indicated in the Table below. Each formulation is prepared to have, for purposes of this test, a 1% sulfated ash level (ASTM D 874) or 0.6% for a baseline fluid, as noted in the table. Each lubricant formulation contains, in addition to the materials noted in the table, 6.1% of a viscosity modifier, 0.2% of a pour point depressant, 0.6% friction modifiers, 7.9% succinimide dispersants, 0.57% zinc dialkyldithiophosphate, 3.6% antioxidants, and small amounts of other conventional components including silicone antifoam agent. Amounts and TBN values as reported include diluent oils (uncorrected).

Each formulation is tested in a modified trunk piston oxidation test which is modified by fuel dosing with rapeseed methyl ester (RME) as described below. A 100 mL sample of the candidate lubricant is additized with Fe naphthenate at 150 ppm Fe to stimulate oxidation. The lubricant is placed into a glass tube with an air inlet. The tubes are placed into a bath maintained at 170° C. Air is blown into the tubes at 10 L/hr. Samples of test lubricant, 10 mL each, are removed at 72, 96, 120, 144, and 168 hours for evaluation. After each sampling, beginning at 96 hours, 5 mL of RME is added to the remaining lubricant in each tube. The fresh oils and the samples removed from the test are analyzed for kinematic viscosity at 40 and 100° C. (KV40 and KV100). Moreover, at the end of the tests, the glass tubes are photographed as an evaluation of the severity of deposit formation.

| Component, % | | Ex 1** | Ex 2* | Ex 3* | Ex 4* | Ex 5 |
|---|---|---|---|---|---|---|
| Overbased Ca sulfonate, 400 TBN (42% oil) | | 0.18 | 0.18 | 0.90 | 0.18 | 0.18 |
| Overbased Ca phenate, 255 TBN (39% oil) | | 1.1 | 2.4 | 1.1 | 1.1 | 1.1 |
| Overbased Ca salixarate, 250 TBN (56% oil) | | 0.2 | 0.2 | 0.2 | 1.4 | 0.2 |
| Overbased Na sulfonate, 448 TBN (31% oil) | | 0 | 0 | 0 | 0 | 0.6 |
| Sulfated ash, % | | 0.6 | 1.0 | 1.0 | 1.0 | 1.0 |
| Test results at time (hours) | | | | | | |
| 0 | KV40 | 71.3 | 73.8 | 72.6 | 74.0 | 74.7 |
| | KV100 | 11.9 | 12.3 | 12.1 | 12.1 | 12.0 |
| 72 | KV40 | 67.1 | 70.1 | 66.1 | 70.5 | 65.8 |
| | KV100 | 10.7 | 11.1 | 10.6 | 10.7 | 10.5 |
| 96 | KV40 | 64.1 | 67.5 | 68.4 | 73.0 | 66.1 |
| | KV100 | 10.2 | 10.6 | 10.5 | 11.1 | 10.3 |
| 120 | KV40 | 86.0 | 85.4 | 93.2 | 76.6 | 70.4 |
| | KV100 | 12.2 | 12.3 | 12.9 | 11.3 | 10.5 |
| 144 | KV40 | 205.8 | 124.9 | 135.9 | 98.0 | 69.6 |
| | KV100 | 17.6 | 14.0 | 15.4 | 13.0 | 10.5 |
| 168 | KV40 | *** | 305.0 | 243.5 | 190.1 | 80.1 |
| | KV100 | 58.2 | 18.7 | 19.4 | 17.0 | 11.6 |

*A comparative example
**Baseline formulation (comparative)
***Too viscous to measure (Experiments in which 7.5% of a biodiesel fuel material is included at the start of a similar test in a different lubricant formulation (before addition of sodium sulfonate) show severe viscosity increase by the time of the first sampling at about 70 hours, before addition of any sodium sulfonate. Addition of an overbased sodium sulfonate at the time of first sampling in such an experiment does not appear to lead to evident subsequent improvement in performance, apparently because of inadequate mixing or inhomogeneity of mixing of the sodium sulfonate into the viscous sample. It may therefore be desirable to incorporate overbased sodium sulfonate prior to significant degradation of a lubricant.)

In the baseline formulation, example 1, the viscosity begins to increase significantly after the first addition of RME at 96 hours, as reflected in the measurements at 120, 140, and 168 hours, indicating oxidative degradation of the lubricant. In comparative examples 2, 3, and 4 as well as in example 5, the increased amount of overbased detergent of any type has little or no effect on the viscosity for the first 96 hours of the test, that is, before addition of the RIME.

After the addition of RME, however, (120, 144, and 168 hour measurements), significant differences appear among the samples. In examples 2, 3, and 4, the increased amounts of calcium phenate, sulfonate, and salixarate detergents, respectively, leads to a modest improvement in stability. The 100° C. viscosity at 168 hours, for instance, is reduced from 58.2 to 17-19.4, although the "improved" values still exhibit an increase (worsening) in viscosity of about 50% from the start of the test, and the 40° C. viscosity increases by about 150% to about 300%. In contrast, when the same amount (on an effective TBN basis) of overbased sodium sulfonate is added, the results show dramatic improvement. The 168 hour viscosity at 100° C. shows substantially no change from its starting value, and the viscosity at 40° C. has increased by less than 8%.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain atoms other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a sump-lubricated internal combustion engine fueled by a liquid fuel which comprises a middle distillate fuel and about 2 to about 50 percent by weight of a C1-C4 alkyl ester of a carboxylic acid of about 12 to about 24 carbon atoms, comprising supplying to the sump a lubricant comprising a mineral oil of lubricating viscosity, and a minor amount of an oil-soluble overbased sodium sulfonate detergent which is present at about 0.02 to about 5 percent by weight of the lubricant composition, being in an amount to provide about 250 to about 5000 parts by million by weight of sodium to the lubricant composition.

2. The method of claim 1 wherein the alkyl ester comprises a methyl ester of a fatty acid derived from an animal or vegetable source.

3. The method of claim 1 wherein a portion of the alkyl ester has accumulated in the lubricant sump.

4. The method of claim 1 wherein the lubricant further comprises about 1 to about 10 weight percent of a nitrogen-containing dispersant.

5. The method of claim 4 wherein the nitrogen-containing dispersant comprises a succinimide dispersant prepared by the thermal "ene" process or a succinimide dispersant prepared by the chlorine process.

6. The method of claim 1 wherein:

the C1-C4 alkyl ester comprises a methyl ester of a carboxylic acid of about 12 to about 24 carbon atoms;

the amount of the overbased sodium sulfonate detergent in the lubricant is about 0.2 to about 2 percent by weight and provides about 500 to about 3000 parts per million by weight of sodium to the lubricant composition;

and where the lubricant composition further comprises:

about 1 to about 10 percent by weight of a nitrogen-containing dispersant; and about 0.15 to about 4.5 percent by weight of an antioxidant.

7. The method of claim 6 wherein the mineral oil comprises a major portion of the lubricant composition.

8. The method of claim 1 wherein the lubricant further comprising about 0.05 to about 5 percent by weight of a calcium detergent.

9. The lubricant of claim 8 wherein the calcium detergent has a metal ratio of about 1 to about 12 and wherein the lubricant contains less than 500 parts per million magnesium.

10. A lubricant composition comprising (a) a mineral oil of lubricating viscosity;

(b) at least about 1 percent by weight of a C1-C4 alkyl ester of a carboxylic acid of about 12 to about 24 carbon atoms, which arises from dilution of the lubricant by a liquid fuel which comprises a middle distillate fuel and about 2 to about 50 percent by weight of said ester; and (c) a minor amount of an oil-soluble overbased sodium sulfonate detergent which is present at about 0.02 to about 5 percent by weight of the lubricating composition, being in an amount to provide about 250 to about 5000 parts by million by weight of sodium to the lubricant composition.

11. The lubricant of claim 10 further comprising about 1 to about 10 weight percent of a nitrogen-containing dispersant.

12. The lubricant of claim 10 wherein:

the C1-C4 alkyl ester comprises a methyl ester of a carboxylic acid of about 12 to about 24 carbon atoms;

the amount of the overbased sodium sulfonate detergent in the lubricant is about 0.2 to about 2 percent by weight and provides about 500 to about 3000 parts per million by weight sodium to the lubricant composition;

and where the lubricant composition further comprises:

about 1 to about 10 percent by weight of a nitrogen-containing dispersant; and about 0.25 to about 4.5 percent by weight of an antioxidant.

13. The lubricant of claim 12 wherein the mineral oil comprises a major portion of the lubricant composition.

14. The method of claim 13 wherein the calcium detergent has a metal ratio of about 1 to about 12 and wherein the lubricant contains less than 500 parts per million magnesium.

15. The lubricant composition of claim 10 further comprising about 0.05 to about 5 percent by weight of a calcium detergent.

16. A method of reducing oxidative degradation of a lubricant composition which contains an oil of lubricating viscosity and at least about 1 percent by weight of a C1-C3 alkyl ester of a carboxylic acid of about 12 to about 24 carbon atoms, which arises from dilution of the lubricant by a liquid fuel which comprises a middle distillate fuel and about 2 to about 50 percent by weight of said C1-C3 alkyl ester, comprising including within said lubricant composition a minor amount of an oil-soluble overbased sodium sulfonate detergent, which is present in an amount of about 0.01 to about 5 percent by weight of the lubricant composition and to provide about 250 to about 5000 parts by million by weight of sodium to the lubricant composition.

* * * * *